United States Patent [19]

Halas

[11] 4,188,305

[45] Feb. 12, 1980

[54] SURFACTANT FOR AN AUTOMATIC DISHWASHER

[75] Inventor: Linda A. Halas, Fairfield, Ohio

[73] Assignee: The Procter & Gamble Company, Cincinnati, Ohio

[21] Appl. No.: 863,379

[22] Filed: Dec. 22, 1977

[51] Int. Cl.[2] ..... C11D 7/54; C11D 7/60

[52] U.S. Cl. ..... 252/95; 252/103; 252/187 H; 8/108 R; 568/618

[58] Field of Search ..... 252/103, 99, 95, 187 A; 8/108 R; 260/615

[56] References Cited

U.S. PATENT DOCUMENTS

| | | | |
|---|---|---|---|
| 3,544,473 | 12/1970 | Kitchen et al. | 252/99 |
| 3,600,317 | 8/1971 | Lintner | 252/99 |

*Primary Examiner*—Mayer Weinblatt

*Attorney, Agent, or Firm*—Robert B. Aylor; Richard C. Witte; Thomas H. O'Flaherty

[57] ABSTRACT

A surfactant which is the condensation product of a fatty alcohol containing from 17 to 19 carbon atoms with from about 6 to about 15 moles of ethylene oxide, the distribution of the ethylene oxide condensation products being such as to give more than about 50% by weight within ±2 ethylene oxide moieties of the average, preferably, no single condensation product (a single specific number of ethylene oxide moieties) constituting more than 50% by weight of the product; automatic dishwasher compositions containing said surfactant.

6 Claims, No Drawings

SURFACTANT FOR AN AUTOMATIC DISHWASHER

CROSS-REFERENCE TO RELATED APPLICATIONS

This application is related to the copending applications of Halas et al, Ser. No. 849,131, filed Nov. 7, 1977; Gilbert et al, Ser. No. 849,132, filed Nov. 7, 1977; and Barford et al, Ser. No. 849,206, filed Nov. 7, 1977, now abandoned, said applications being incorporated herein by reference.

BACKGROUND OF THE INVENTION

This invention relates to certain specific surfactant compounds which are particularly suitable for use in automatic dishwashers. These surfactants are extremely low foaming thus requiring a minimal amount of suds suppressor. Similar products prepared by condensing 1 mole of octodencanol and 9 or 10 moles of ethylene oxide have been disclosed in U.S. Pat. No. 3,630,923, Simmons et al (Dec. 28, 1971) and in U.S. Pat. No. 3,544,473, Kitchen et al (Dec. 1, 1970) both of said patents being incorporated herein by reference. These two patents, however, are not enabling with respect to the present invention for it has been found that a very specific tight distribution of ethylene oxide homologs gives preferred performance in that less suds suppressor is required to give a desirable low sudsing automatic dishwasher composition.

SUMMARY OF THE INVENTION

This invention is based upon the discovery that a nonionic surfactant derived by condensing very specific fatty alcohols, preferably straight chain, with a specific amount of ethylene oxide to obtain, either directly, or indirectly after further treatment, a condensation product having a narrow distribution of homologs having different ethylene oxide contents is a superior surfactant for use in automatic dishwashing detergents. More specifically, this invention relates to a low foaming nonionic surfactant prepared by condensing a $C_{17}$–$C_{19}$ alcohol, preferably straight chain, preferably saturated, preferably having an essentially pure (>90%, preferably>95%) chain length, more preferably $C_{18}$, with from about 6 to about 15 moles, preferably from about 7 to about 12 moles, most preferably 9 moles, of ethylene oxide per mole of fatty alcohol to give, either directly, or indirectly after further treatment, a distribution of ethylene oxide homologs in which more than about 50%, preferably more than about 60%, of the product by weight is within ±2 ethylene oxide moieties from the average (preferably, no more than 50% of the surfactant comprises a single ethylene oxide homolog). A more preferred product contains less than about 2% unethoxylated alcohol and more than about 80% by weight of said product should contain less than about 13 ethylene oxide moieties.

The invention also relates to automatic dishwashing detergent compositions consisting essentially of:

1. from about 10% to about 90%, preferably from about 20% to about 70% of a detergency builder;
2. available chlorine at a level of from 0% to about 3%, preferably from about 1% to about 2.5%; and
3. from about 2.5% to about 30%, preferably above 5%, more preferably below about 20%, most preferably below about 10% of the above described low foaming, biodegradable nonionic surfactant.

DETAILED DESCRIPTION OF THE INVENTION

The Surfactant

The condensation product of this invention can be obtained by using a high level of very strong alkaline catalyst such as sodium metal or sodium hydride, e.g., a 1:1 molar ratio of catalyst to alcohol or by "stripping" a conventional ethoxylated alcohol. "Stripping" will not normally be an acceptable way of preparing the preferred products containing 80% by weight of the homologs with less than about 13 ehtylene oxide moieties. The various specific $C_{17}$–$C_{19}$ polyethoxylates give extremely good performance even at lower levels (e.g., 2.5% to 3%) and at higher levels, e.g., about 5%, are sufficiently low sudsing so as to minimize or eliminate the need for a suds supressing agent. This is highly desirable since suds suppressing agents in general tend to act as loads on the composition and hurt long term spotting and filming (S/F) characteristics.

The surfactants of this invention are particularly adapted for use in the compositions of U.S. Ser. No. 849,131 referred to hereinbefore. However, the surfactants are equally desirable for use in any automatic dishwashing composition where good cleaning, low sudsing, and improved biodegradability are desirable. The surfactants give extremely good spotting and filming results. Although similar surfactants with a normal polyethoxylate distribution can give equally good spotting and filming and cleaning results, the sudsing characteristics of the surfactants having a tight polyethoxylate distribution are such that they give a lower level of suds and/or require less suds suppressor to provide an acceptable level of suds.

The compounds of this invention can be prepared by the processes described in U.S. Pat. Application Ser. No. 749,654, filed Dec. 10, 1976, by Joseph McGrady and U.S. Pat. Application Ser. No. 749,653, filed Dec. 10, 1976, by Haydee Ramirez Guilloty, both of said patent appliations being incorporated herein by reference.

The Detergency Builder

The detergency builder can be any of the known detergent builders. Suitable builders include: trisodium phosphate, tetrasodium pyrophosphate, sodium acid pyrophosphate, sodium tripolyphosphate, sodium hexametaphosphate, sodium silicates having $SiO_2$:$Na_2O$ ratios of from about 1:1 to about 3.6:1, sodium carbonate, sodium hydroxide, sodium citrate, borax, sodium ethylenediaminetetraacetate, sodium nitrilotriacetate, sodium carboxymethyloxysuccinate, and mixtures thereof. Although the sodium salts are the most commonly used potassium, ammonium, and substituted ammonium (e.g., methyl, ethyl, monoethanol, diethanol, and triethanol ammonium) salts can be substituted. In general the ammonium and substituted ammonium salts will only be used when there is no active chlorine compound present. Preferably there will be at least about 10% of a sequestering builder present. Further disclosures of suitable builder salts can be found in the previously incoporated patent applications and patents.

The Source of Available Chlorine

The source of available chlorine is a chlorine bleach component, a compound which contains chlorine in active form. Such compounds are often characterized as hypochlorite compounds and are well known as a class. Desirably, at least 0.5% available should be used. It has been found that automatic dishwashing compositions which have a source of available chlorine in an amount sufficient to provide available chlorine equal to about 1% to about 4% by weight of the composition are preferred. A more preferred level is from about 1.25% to about 3% by weight of the composition. It has been found that a high level of available chlorine provides improved cleaning, especially on starchy soils, and improved spotting/filming.

The preferred source of available chlorine is chlorinated trisodium phosphate. However, other materials which can be used are: sodium and potassium dichlorocyanurates, dichlorocyanuric acid; 1,3-dichloro-5,5-dimethyl hydantoin; N,N'-dichlorobenzoylene urea; paratoluene sulfondichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Of the other materials, sodium and potassium dichlorocyanurates are preferred for effectiveness, stability, availability, etc.

Although it is preferred to have a source of available chlorine present, acceptable products can be formulated without any such source. In that case, it is desirable to have enzymes present.

Other Ingredients

In addition to the above ingredients it may be desirable, if the product sudses too much, to incorporate one of the many suds-suppressing ingredients disclosed in the above mentioned patents which have been incorporated by reference at a level of from about 0.001% to about 10%, preferably from about 0.05% to about 3%. The preferred suds suppressing materials are mono- and distearyl acid phosphates; the self-emulsified siloxane suds-suppressors of pending U.S. Pat. application Ser. No. 841,078, filed Oct. 11, 1977, now U.S. Pat. No. 4,136,045 issued Jan. 23, 1979, by T. W. Gault and Edward John McGuire, Jr. and mixtures thereof. In general, lower amounts of, or no, suds-suppressors are preferred. Less than 0.2%, preferably less than 0.1% is desirable, more preferably none for best S/F, long term.

Enzymes are also desirable in compositions which do not contain a source of available chlorine. Suitable enzymes are those disclosed in U.S. Pat. Nos. 3,519,379 issued to Blomeyer et al and 3,655,568 issued to Zaki et al and especially those disclosed in copending U.S. Pat. Applications Ser. Nos. 699,415, filed June 24, 1976, now U.S. Pat. No. 4,101,457 issued July 18, 1978 by Place et al; 699,416, filed June 24, 1976, now abandoned, by Maguire et al; and 847,982, filed Nov. 2, 1977, by Boyer all of said patents and patent applications being incorporated herein by reference.

China protecting agents including sodium or potassium aluminosilicates, aluminates, etc., may be present in amounts of from about 0.1% to about 5%, preferably from about 0.5% to about 2%.

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts.

Dyes, perfumes, crystal modifiers and the like can also be added in minor amounts.

As used herein, all percentages, parts and ratios are by weight unless otherwise stated.

The following Examples illustrate the invention and facilitate its understanding.

EXAMPLE I

"Normal"condensation products of octadecanol and 7.5 moles of ethylene oxide (containing 2.1% unethoxylated alcohol, 40.3% ethoxylate products within ±2 ethylene oxide moieties of the average, and 25.9% of condensation products having more than 13 ethylene oxide moieties) and the condensation product of octadecanol and 9.7 moles of ethylene oxide (containing 2.1% unethoxylated alcohol, 38.7% of condensation products having ethoxylated chain lengths with ±2 ethylene oxide moieties of the average, and 17.3% of condensation products containing 13 or more ethylene oxide moieties) were compared with surfactants within the scope of this invention. The octadecanol in each instance contains 96.1% $C_{18}$, 2.5% $C_{16}$, 0.8% $C_{20}$, and 1.4% other alcohols.

The products representative of the compositions of this invention were condensation products of octadecanol with 7.6 and 9.1 moles of ethylene oxide respectively. The reaction utilized an essentially equimolar sodium metal to octadecanol ratio with ethylene oxide addition being initiated before the completion of the reaction between the catalyst and the octadecanol to preserve the liquid nature of the reaction mix. The resulting products had 0.7% and 0.4% respectively of unethoxylated alcohol; 62.8% and 50.3% respectively of condensation products within ±2 ethylene moieties of the average; and 2.1% and 14.5% respectively of condensation products containing 13 or more ethylene oxide moieties.

These surfactants were incorporated in an automatic dishwashing composition containing 22% sodium tripolyphosphate, 40% Chlorinated trisodiumphosphate, 10% 2.0 ratio liquid sodium silicate, 13% 3.2 ratio liquid sodium silicate, 5% 2.0 ratio anhydrous sodium silicate, 2.3% sodium carbonate, 7.5% surfactant and either 0.1% or 0.2% of monostearyl acid phosphate as a suds suppressor.

When tested in conventional spotting and filming tests, the surfactants having the normal distribution and the tight distribution have essentially equal outstanding performance. However, in separate sudsing tests the $C_{18}E_{7.5}$ product with normal distribution required 0.2% of the suds suppressor to give acceptable sudsing (slight sudsing with some spray arm obstructions occurring) and when only 0.1% of the suds suppressant was used, the spray arm was partially obstructed. With the $C_{18}E_{9.7}$ product having a normal distribution, neither 0.1% nor 0.2% of the suds suppressor was able to stop the sudsing and in both instances there was high sudsing with the spray arm being very obstructed. In contrast, the $C_{18}E_{7.6}$ material with a tight distribution gave acceptable sudsing with 0.1% or 0.2% of the suds suppressor and the $C_{18}E_{9.1}$ material with the tight distribution gave acceptable sudsing with 0.2% of the suds suppressor although it did not with 0.1% of the suds suppressor.

Therefore, for essentially equal ethylene oxide content it was clearly demonstrated that the peaked distribution gave lower sudsing.

When, in the above Example, trisodiumphosphate, tetrasodiumpyrophosphate, sodium acid pyrophosphate, sodium hexametaphosphate, sodium carbonate, sodium hydroxide, sodium citrate, borax, sodium methylenediaminetetraacetate, sodium nitrilotriacetate, sodium carboxymethyloxysuccinate, and mixtures thereof are substituted, either wholly, or in part, for the sodium tripolyphosphate, substantially equivalent results are obtained in that the compositions are desirably low sudsing.

When in the above compositions, sodium or potassium dichlorocyanrates, dichlorocyanuric acid, 1,3-dichloro-5,5-dimethyl, N,N'-dichlorobenzolene urea, paratoluene sulfondichloroamide, trichloromelamine; N-chloroammeline; N-chlorosuccinamide; N,N'-dichloroazodicarbonamide; N-chloroacetyl urea; N,N'-dichlorobiuret; chlorinated dicyandiamide; sodium hypochlorite; calcium hypochlorite; and lithium hypochlorite, or mixtures thereof are substituted for the chlorinated trisodiumphosphate, substantially equivalent results are obtained in that desirably low sudsing compositions are formed.

What is claimed is:

1. An automatic dishwashing detergent composition consisting essentially of:

(1) from about 10% to about 90% of the detergency builder;

(2) available chlorine at a level of from 0% to about 3%; and (3) from about 2.5% to about 30% of a low foaming nonionic surfactant which is the condensate of an alcohol containing from 17 to 19 carbon atoms with from about 6 to about 15 moles of ethylene oxide per mole of fatty alcohol, at least 50% of the ethylene oxide homologs containing within ±2 ethylene oxide moieties of the average.

2. The composition of claim 1 wherein at least about 75% of said alcohol contains 18 carbon atoms.

3. The composition of claim 1 wherein said alcohol is a straight chain, saturated fatty alcohol.

4. The composition of claim 1 containing at least 5% of said surfactant.

5. The automatic dishwashing detergent composition of claim 4 containing:

(1) from about 20% to about 70% of the detergency builder;

(2) from about 1% to about 2.5% available chlorine; and (3) from about 5% to about 20% of said surfactant.

6. The automatic dishwashing detergent composition of claim 5 containing from about 5% to about 10% of said surfactant.

* * * * *